United States Patent [19]

Kunce

[11] 4,308,961

[45] Jan. 5, 1982

[54] ARTICLE SUPPORTING STRUCTURE

[76] Inventor: Thomas M. Kunce, 7946 Birchdale Ave., Elmwood Park, Ill. 60635

[21] Appl. No.: 146,757

[22] Filed: May 5, 1980

[51] Int. Cl.[3] ..... A47F 5/00

[52] U.S. Cl. ..... 211/94.5; 211/57.1; 248/222.2; 248/307

[58] Field of Search ..... 211/57.1, 105.1, 94, 211/94.5; 248/225.1, 307, 222.2

[56] References Cited

U.S. PATENT DOCUMENTS

| | | | |
|---|---|---|---|
| 1,800,387 | 4/1931 | Greist | 248/307 |
| 3,337,172 | 8/1967 | Jackson | 248/222.2 |
| 4,094,415 | 6/1978 | Larson | 211/94 |

*Primary Examiner*—Ernest R. Purser

*Attorney, Agent, or Firm*—W. A. Snow

[57] ABSTRACT

An elongated rail or channel and hook or article supporting member wherein the rail is provided at one side with a flanged channel on its upper surface extending over and above said rail and a shorter arcuate bend lying over and above said rail at the other side in combination with the hook or article supporting member having an elevated medial portion having an offset lower wall terminating in a right angled bend extending above the wall, while the other side is offset downwardly and outwardly below the elevated portion, the elevated portion having an integrally formed, outwardly extending rod whereby when said hook is snapped into said rail, it will be retained therein and be freely movable laterally.

3 Claims, 5 Drawing Figures

ARTICLE SUPPORTING STRUCTURE

BACKGROUND OF THE INVENTION

Home owners and others usually like to hang their garden equipment and tools on a wall or on studs. The usual way is to drive long nails into the wall or stud or drill holes and insert pegs therein, thus they were not movable. It was to overcome the foregoing that the present invention was conceived.

SUMMARY OF THE INVENTION

An elongated flat rail or track member may be adapted to be secured to a wall or studs having a base 11, one terminal side being formed with a flanged channel extending over the base 11, and the lower side bent back arcuately and lying over the base. The hook or article supporting member 26 comprises an elevated base member from which a rod extends outwardly thereof, and said elevated member has an integrally formed, offset downwardly and outwardly, extending portion at one side and below the base and the other side has an integrally formed, offset downwardly member terminating in a right angle bend whereby when the right angled member is placed under the channel member, the other side may be snapped into the rail member anywhere along its length and be slidable therein.

DETAILED DESCRIPTION OF THE DRAWINGS

Figure 1:
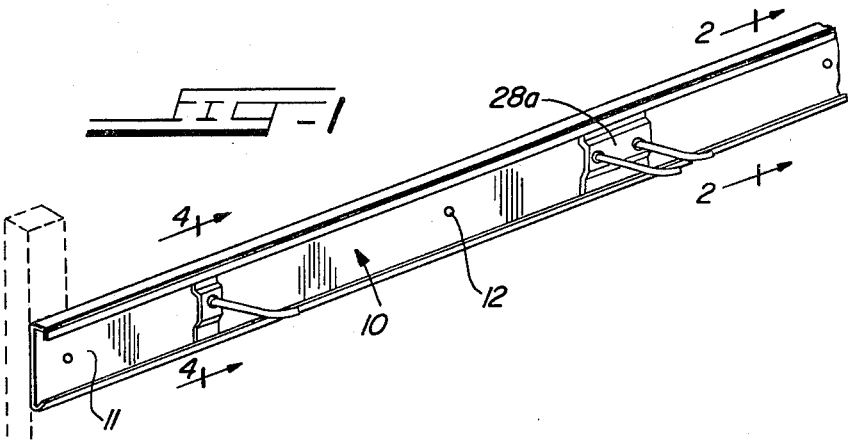
FIG. 1 is a perspective view of the device of the present invention disclosing one and two hook members mounted in the rail.

The elongated rail or channel member has a flat base 10 having a series of apertures 12 therein along its length where wood screws 14 may be passed therethrough to anchor the rail to a wall 16 or a stud. The screws preferably have a head 18. As shown in the drawings, the upper side of the base 10 is bent at right angles as at 20 and again at right angles inwardly as at 22 forming a channel.

The opposite or lower side of the base 10 is provided with an arcuate bend 24 which extends upwardly and inwardly to lie over the lower side of the base.

The hook or article supporting member 26 has an elevated base member 28 to which a collar 30 is welded or otherwise secured and in which one end of a rod 32 is anchored. The rod 32 is bent upwardly at its free end 34 so that the rod forms a hook attached to its base 28.

The upper portion 35 of the base 28 is offset as shown in the drawings and has its terminal end 36 bent at right angles while the lower end is also offset and bent downwardly and outwardly from the base as at 38 and then the terminal end is slightly bent rearwardly as at 40.

Figure 2:
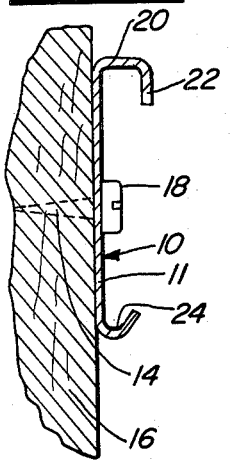
FIG. 2 is a cross-sectional view taken on the line 2—2 of FIG. 1.
Figure 4:
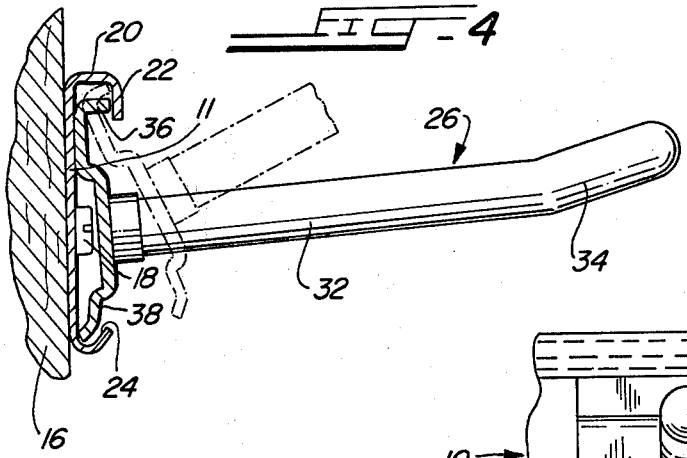
FIG. 4 is a cross-sectional view taken on the line 4—4 of FIG. 1, the broken lines illustrating how the hook base is snapped into the elongated rail at any point along its length.

In operation, after the rail 10 has been appropriately anchored to a wall or studs, for instance in a garage, both in a substantially horizontal plane and with the channel at the upper end as shown in FIGS. 2 and 4, the member 36 is placed in the flange between the member 22 and the base 10 and the terminal end 40 snapped or forced behind the free end of the arcuate member 24 anywhere along the length of the rail. The terminal end 40 will lie in the arcuate portion 34 and the member 36 will lie against the inner wall of right angled member 22.

Figure 3:
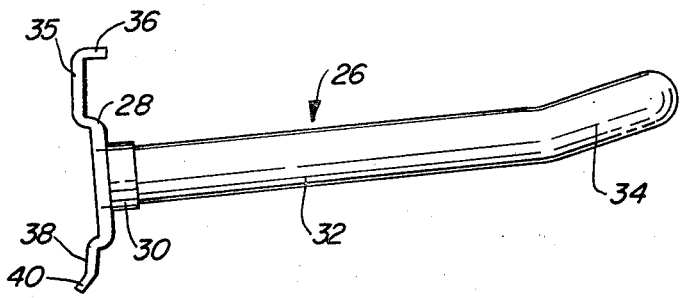
FIG. 3 is a side elevational view of the hook or article supporting member.

As seen in FIG. 4, the hook or article supporting member of FIG. 3 is free to move in both lateral directions in the rail.

Normally several hooks 26 are used in the rail 10.

Figure 5:
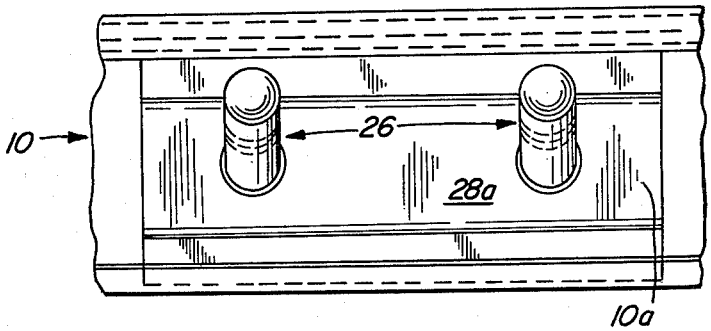
FIG. 5 is a front elevational view showing a pair of hook members on a single base member.

In FIG. 5, there is shown a pair of hooks 26 mounted on an elongated base 10*a*. All of the other features of the hook 26 are identically constructed, as heretofore described.

It should be considered that three or four hooks may be mounted on an elongated base 10*a*, if desired.

It should be further understood that several hook members 26 are readily mounted and demounted in rail 10 as described.

It is to be understood that numerous details may be altered or omitted without departing from the spirit of this invention as defined by the following claims.

I claim:

1. An article supporting device comprising an elongated rail having a flat base member adapted to be anchored to a wall or stud and having upper and lower sides, a channel member on the upper side of said base, the terminal end of which extends over a portion of said base, and an arcuate member extending upwardly and inwardly and lying over a portion of said base, in combination with a hook member having an elevated base, and a rod anchored at one end to said base and extending outwardly therefrom, said elevated base having an upper and lower side, an integrally formed offset portion on the upper side of said elevated base extending therebelow and terminating in a right angled member, an integrally formed offset portion on the lower side of said base extending below said base and terminating downwardly and inwardly, whereby when said right angled portion is placed in said channel and the terminal end of the offset lower member snapped over said arcuate member, the hook member will be slidably secured in said rail.

2. The device according to claim 1 wherein said article supporting member is constructed of steel and the free end of said rod is bent upwardly angularly.

3. The device according to claim 1 wherein said elevated base is elongated and provided with a pair of spaced hook members.

* * * * *